US005247148A

United States Patent [19]

Mencher

[11] Patent Number: 5,247,148

[45] Date of Patent: Sep. 21, 1993

[54] MICROWAVE FLUID HEATER WITH CAPACITIVE PLATES

[76] Inventor: Alexander Mencher, 69-42 Ingram St., Forest Hills, N.Y. 11375

[21] Appl. No.: 890,727

[22] Filed: Jun. 1, 1992

[51] Int. Cl.[5] ..... H05B 6/80

[52] U.S. Cl. ..... 219/10.55 A; 219/10.51

[58] Field of Search ..... 219/10.55 A, 10.55 R, 219/10.65, 10.51, 10.81

[56] References Cited

U.S. PATENT DOCUMENTS

| | | | |
|---|---|---|---|
| 1,934,704 | 11/1933 | Golden | 219/10.65 |
| 2,508,365 | 5/1950 | Bierwirth | 219/10.65 |
| 2,602,134 | 7/1952 | Nelson | 219/10.65 |
| 3,812,315 | 5/1974 | Martin | 219/10.65 |
| 4,152,567 | 5/1979 | Mayfield | 219/10.55 A |
| 4,178,494 | 12/1979 | Bottalico et al. | 219/10.55 R |
| 4,358,652 | 11/1982 | Kaarup | 219/10.55 A |
| 4,429,203 | 1/1984 | Ramer | 219/10.55 A |

*Primary Examiner*—Philip H. Leung

[57] ABSTRACT

Water or other fluid is rapidly heated and supplied by micro-wave radiation on demand and at a preset and desired temperature by the invention herein. There is provided a chambered conduit serving as a reservoir for fluid therein and passing therethrough and of low volumetric capacity such as in the shape of a flat cylindrical tube. Subjection to micro-wave radiation of the full area of the chamber and penetration thereof throughout the full contents enables the transfer of micro-wave energy to the contents uniformly, equally and simultaneously for rapid and safe heating. The chamber is provided with conductive plates energized by a high frequency voltage generator and with a thermally controlled switching device to control the temperature of the fluid contents by directing and terminating the production and supply of micro-wave energy to the conductive plates.

5 Claims, 2 Drawing Sheets

MICROWAVE FLUID HEATER WITH CAPACITIVE PLATES

BACKGROUND OF THE INVENTION

The invention relates generally to rapid micro-wave heaters for water and other fluids, but more specifically to heaters taking up small space and adapted for installation adjacent to places or areas having plumbing facilities available. Such places include public or private bath rooms, wash rooms and other locations where hot water is desired or required immediately, on demand and sustained during use.

A principal object of the invention is to provide novel and improved structure and system to overcome disadvantages of micro-wave heating processes based on liquid temperature gradients. Such processes involve complicated and bulky equipment, duplication of procedures and inefficient operation by reason of conduction and convection factors. As an example, U.S. Pat. No. 3,812,315 issued to Norman Eugene Martin on May 21, 1974 entitled MICRO-WAVE HEATER resorts to such processes utilizing a continuous and elongated coiled tube as the heating reservoir, several pairs of dielectric plates, and a series of switching mehanisms for directing sequential radiation to successive reservoir areas.

The invention herein improves over the liquid temperature gradient by providing novel structure and system utilizing a reservoir chamber with or without expandible flow path and with means for radiating a single area of the chamber and penetrating the full molecular contents uniformly, equally and simultaneously. By such procedure, there is a minimization of fluid turbulence, pressure increase with rise in temperature within the system during periods of radiation.

A further object of the invention is to provide a novel and improved compact structure which is light in weight, portable, inexpensive in cost and efficient and economic in operation.

These objects and other ends of the invention will appear hereinafter and in the appended claims.

BRIEF DESCRIPTION OF THE INVENTION

The invention briefly summarized relates to apparatus and system for rapid micro-wave heating of fluids on demand, and is installable wherever an electrical supply outlet and a pressurized water source are available.

System is essentially directed to elimination or minimization of energy-wasteful conduction and convection factors inherent in systems based on liquid temperature gradient processes. Present system is also adapted to counteract pressure buildup, turbulence and vibration during the micro-wave radiation or heating periods.

To this end, the apparatus and system are of low volumetric capacity, either fixed or expandible, and wherein the reservoir chamber as the heating component is dimensioned to allow full penetration of micro-wave energy to the total molecular fluid content. The chamber is provided with both a pair of capacitively positioned conductive plates and a thermally controlled electrical switching means such as a thermostat secured thereto, the latter being adapted to sense and control desired temperature by directing and terminating the production and supply of high frequency voltage to the plates. A high frequency voltage generator produces and supplies such voltage. Thus, by the factors above described, uniform, equal and simultaneous transfer of micro-wave energy to the full molecular fluid content of the chamber for heating is accomplished to bring about the above stated ends of the invention.

Different switching modalities may be adopted to operate the system. As shown herein, the faucet for drawing the heated water is conventionally cammed to serve as an electrical switch simultaneously therewith so that when the faucet is open, the system is activated for micro-wave production and supply at the direction of the thermostat, and when the faucet is closed, the system is deactivated.

SUMMARY OF THE INVENTION

Figure 1:
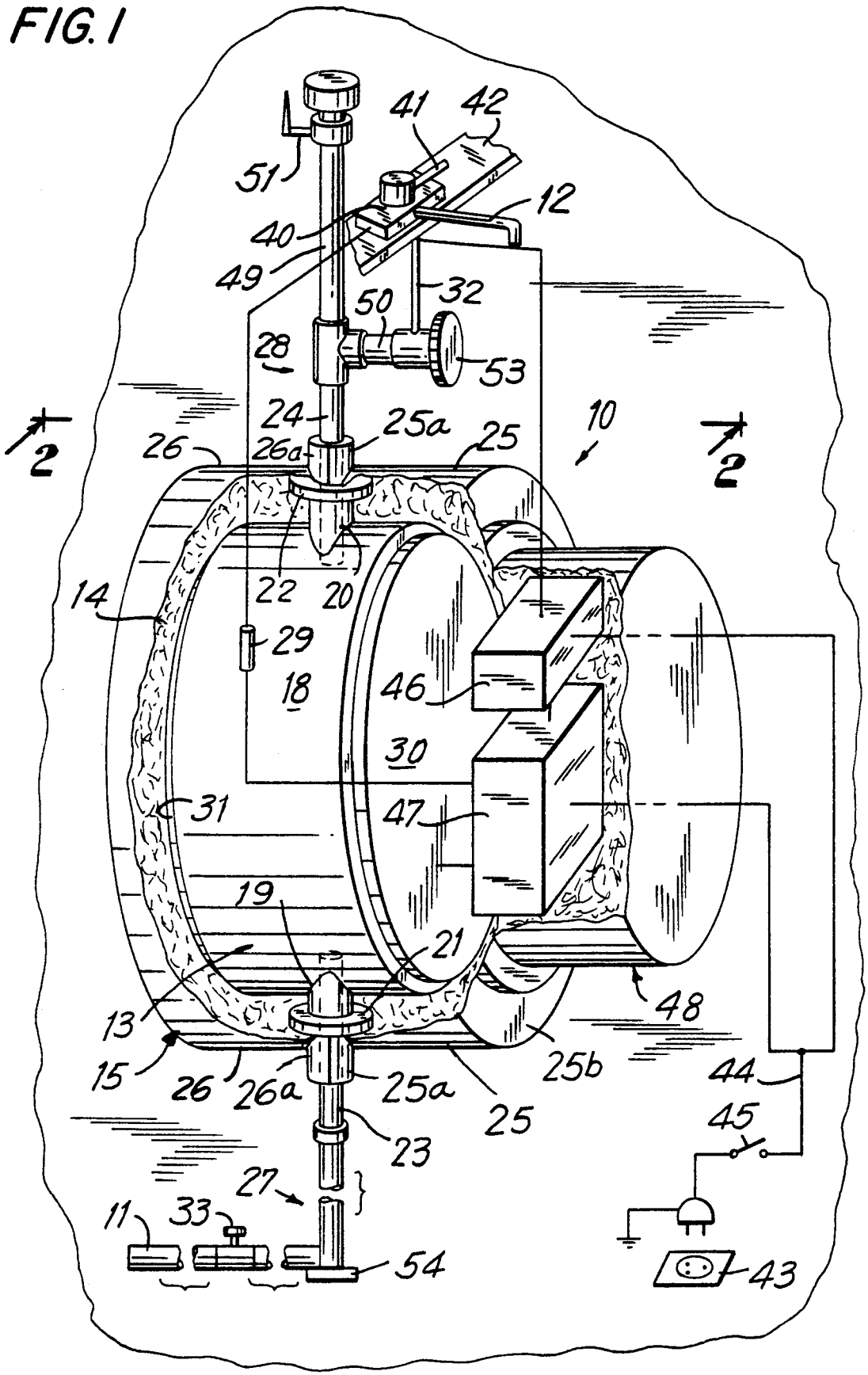
FIG. 1 is a perspective view of the present invention.

In accordance with the invention and the preferred form shown in the drawings wherein similar reference characters designate corresponding parts throughout the several views, numeral 10 generally indicates the complete structure and system. A pressurized cold water source 11 and a hot water faucet 12 indicate the terminals of the system.

A heating chamber generally indicated by numeral 13 and molded or formed from dielectric material such as reinforced Teflon and equipped with a pair of conductive plates 30 and 31 and a thermally operated switch 29 constitutes a primary component of the invention. A blanket of insulation 14 and a metallic casing generally indicated by numeral 15 are further provided for reasons of heat containment and prevention of dissemination of micro-wave radiation to the atmosphere.

Heating chamber 13 is adapted to serve both as an open-ended conduit and as a reservoir for micro-wave heating of the water contents therein and passing therethrough, and to be subjected to micro-wave radiation from the plates 30 and 31 whereby the full molecular water contents of the chamber are penetrated for uniform, equal and simultaneous transfer of micro-wave energy thereto. Such transfer of micro-wave energy is adapted to result in greater rapidity of water heating, minimization of turbulence and pressure development within the system and consequent operational efficiency and safety.

Figure 2:
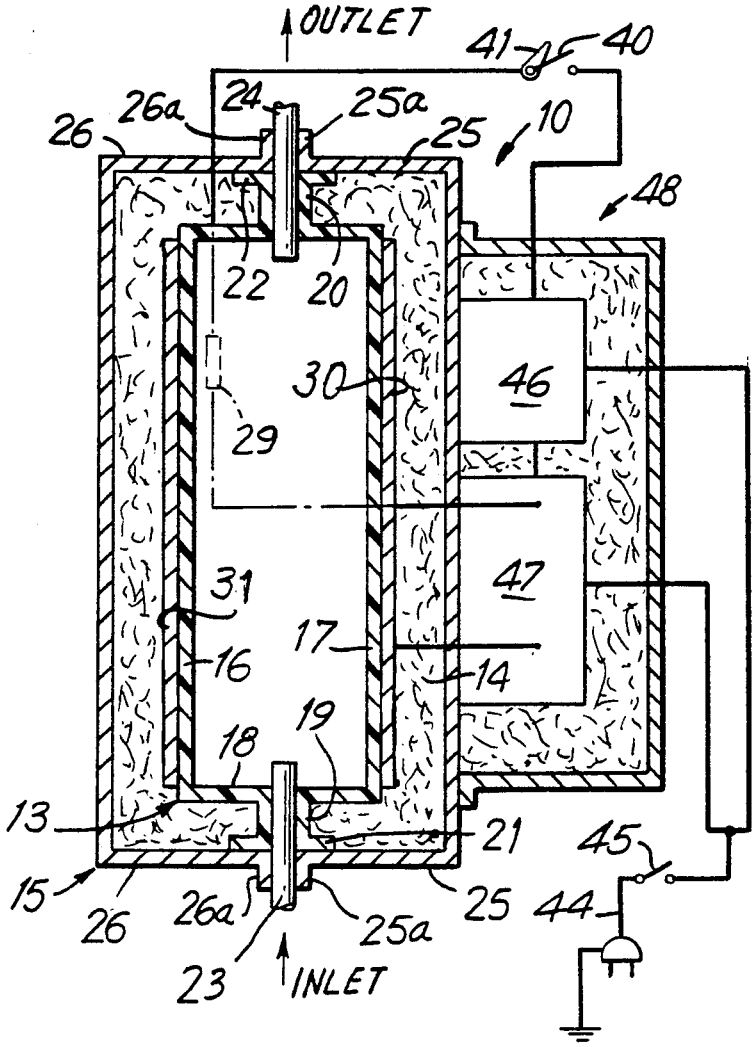
FIG. 2 is a sectional view across the plane 2—2 of FIG. 1.

More specifically and as best shown in FIGS. 1 and 2 of the drawings, chamber 13 is formed in the shape of a flat, cylindrical open-ended vessel. In one dimensional mode, the vessel is of an approximate two-quart volumetric capacity, has a diameter of approximately eight and one-half inches and an elevation of approximately two inches. Flat, closed, parallel and circular end walls 16 and 17 and a cylindrical wall 18 define the boundaries of the chamber, while the open ends are in the shape of tubular lower inlet and upper outlets 19 and 20 respectively, said inlet and outlets projecting from the wall 18 in diametrically opposite positions. Cylindrical wall 18 of the chamber adjacent the upper end serves as the mounting platform for the thermally operated or controlled switch 29 and which is operably attached thereto, said switch being of the standard and adjustable bimetallic thermostat type. Chamber end walls 16 and 17 serve as the mounting platform for plates 30 and 31 and to which said plates are suitably secured.

Chamber 13 and the external flow path of the system include measures for volumetric expandibility to enable safe and efficient operation especially for fluids which are not of uniform molecular composition. As an example, city water contains salts and other impurities having diverse dielectric constants relative to distilled water and when subjected to micro-wave radiation results in differential molecular heating. Such differential heating gives rise to increased turbulence, pressure development and vibration which are sought to be averted during simultaneous radiation and hot water drawing periods as will hereafter be described in one mode of operation of the system.

Volumetric expandibility of the external flow path of the system is effected in any suitable manner such as by the installation of a standard type of hammer arrester used in conjunction with faucet valves and as indicated by numeral 49.

Chamber 13 has suitable and appropriate means for connection with and support of the metallic casing 15 and also for fluid-flow connection to the external plumbing components generally indicated by numerals 27 and 28. Said means include the use of flat and horizontal flanges 21 and 22 at the outer ends of inlet and outlet extensions 19 and 20 respectively and of plastic pipe sections 23 and 24 respectively. Said plastic pipe sections, such as of reinforced Teflon, are suitably secured within inlet and outlet extensions 19 and 20 and project outwardly for connection with said plumbing components 27 and 28.

The above-described connecting means further involves a corresponding configuration and structure of the casing 15. As shown, casing 15 substantially follows the cylindrical shape of chamber 13 and is mounted thereon and in spaced and concentric relationship therewith. Structurally, casing 15 is in the form of a closed cylindrical housing having diametrically opposed inlet and outlet tubular projections extending from the cylindrical wall, said housing being split along and in the middle of cylindrical wall to form abutting and attached body shell portions 25 and 26 and abutting and attached tubular projecting portions 25*a* and 26*a*. Portions 25*a* and 26*a* are adapted to be engaged and attached to the exterior ends of pipes 23 and 24, and shell wall portions 25 and 26 are adapted to be mounted on flanges 21 and 22.

The flow path from the cold water source 11 to hot water faucet 12 in the present invention is best illustrated in FIG. 1. The available plumbing or other source of fluid is suitably tapped as by the external valve fitting 33 for upstream flow through the lower Teflon pipe 23 as the inlet to heating chamber 13. Upper Teflon pipe 24 then serves as the conduit for the heated water from chamber 13 for passage through the intermediate external plumbing components before reaching hot water faucet 12. Such components include Teflon pipe 25*a*, the hammer arrester (H.A.) or shock absorber 49, the latter carrying the flow tube 32 to faucet 12 by arm 50 and also carrying an air-pressure escape valve 51 adjacent the arrester air chamber.

The electrical means adapted to control, produce and supply micro-wave energy to dielectric plates 30 and 31 for transfer to and heat the fluid contents of chamber 13 to any desired target or preset temperature but below 212 degrees F. essentially comprises: a suitable high frequency micro-wave generator as known in the art and indicated herein by numeral 36; a suitable thermally controlled and settable electric switch also known in the art such as bimetallic thermostat 29 adapted to sense and control the temperature of the contents of chamber 13; a manually controlled activating switch 40 forming part of faucet 12 and simultaneously serving as an electrical switch therewith by being cammed for such purpose, the camming structure being conventional. A hand-operated cam disengaging lever is also associated with faucet 12 and indicated by numeral 41 to return fauct 12 to its single water valve function.

Figure 3:
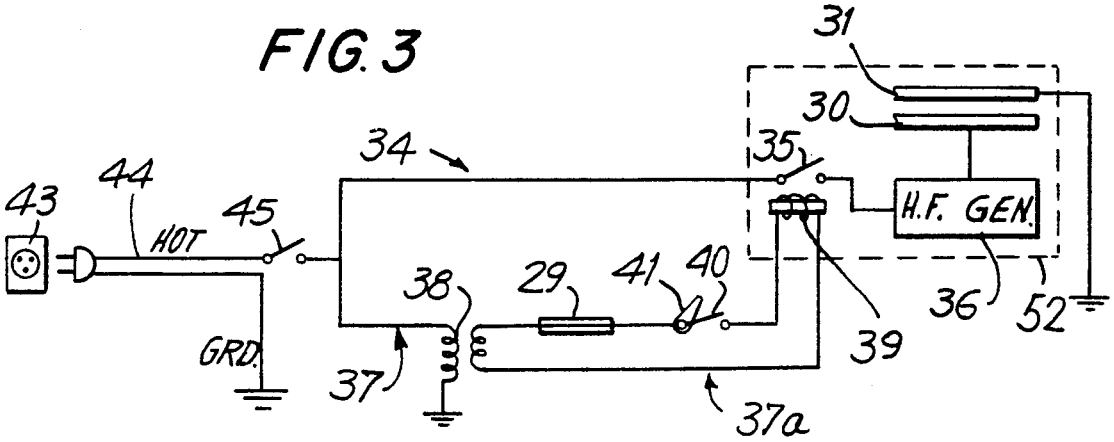
FIG. 3 is a wiring schematic for the invention.

More specifically, suitable and conventional electrical circuitry and components therewith for system operation is best shown in the schematic of FIG. 3. Thus, a source of electric power derives from a 120 volt a.c. electrical outlet 43 and proceeds by wiring 44 through main switch 45 for powering the operating circuits of the system.

The main circuit generally indicated by numeral 34 includes a controlled switch such as relay switch 35 for activating the high-frequency micro-wave generator 36. Said generator connects to conductive transmitter and receiver plates 30 and 31 for energy or micro-wave transfer to the fluid contents of chamber 13 for heating. Another circuit as generally indicated by numeral 37 provides, by means of a stepdown transformer combined with a diode and both indicated by numeral 38, a secondary circuit indicated generally by numeral 37*a*. Said secondary circuit includes: the thermostat 29; the cammed faucet switch 40 carrying the cam disengaging lever 41; and the electromagnet 39 which is adapted to control the relay switch 35 to the generator 36.

It is to be noted that the cammed faucet switch and disengaging lever 41 are mounted on a convenient platform 42; that transformer assembly 38 is mounted as unit 46 on end wall 25*b* of casing shell portion 25; and that micro-wave generator 36 of main circuit 34 and the electromagnet 39 of secondary circuit 37*a* are also mounted as assembly unit 47 on end wall 25*b*, said electrical relationship being indicated in FIG. 3 by rectangle 52. A covering shell for units 46 and 47 generally indicated by numeral 48 is suitably affixed to said end wall 25*b*. It should also be noted, although not shown in the drawings, that metallic casing shell 26 may be provided with a recess in the area above adjustable thermostat 29 for suitable access thereto and for purposes of setting target temperatures to be attained by the system.

And further to be noted is a suitable arrester drain plug 54 at plumbing area 27 for arrester 49, the latter being shown herein in the form of a capped water-pipe section. As has been stated, arrester 49 serves as an air-filled expansion and cushioning chamber for the system and thus may require an air-refill after prolonged use because of air absorbtion by the water within the pipe section.

MODE OF OPERATION

In using the structure of the invention herein, the operator first closes main switch 45 to electrify the system. From this point on, and whenever the faucet water value 12 is opened for hot water flow, thermostat 29 is energized to direct or terminate radiation of the water contents of chamber 13 for temperature control during such flow. At all times and whether main switch 45 is on- or off-position and whenever faucet water valve is in closed position for cutoff of hot water flow, generator 36 is in a deactivated state.

Two modalities are possible for the functioning of faucet 12 to dispense cold water: the first is to have main switch 45 in off position; the second is to have the manually controlled cam lever 41 in cam-disengaging position regardless of the position of switch 45.

Rate of flow from faucet 12 is controllable and depends on many factors such as: the diameter of the faucet flow tube 32; the water pressure of the cold water source 11; and positions of source water valve control 33 and that of a flow-tube valve control 53, the latter being associated with the hammer or shock arrester 49. Thus, the slower the rate of draw of hot water, the longer it takes for the radiated load of water contents in chamber 13 to be dispensed. Under such circumstances, directions from thermostat 29 for radiation replenishment will be less frequent.

I wish it understood that minor changes and variations in structural parts, shapes, conventional circuitry and electrical configurations may all be resorted to without departing from the spirit of the invention and the scope of the appended claims.

I claim:

1. Apparatus for heating fluids therein or flowing therethrough by radiation of the fluid molecules and comprising:

(a) an enclosed cylindrical and dielectric chamber of low volumetric capacity and having inlet and outlet terminals on the cylindrical wall portion of the chamber to define a passage therethrough and a reservoir for said fluids, the end walls of the chamber having a pair of conductive plates capacitively arranged and in engagement with and operably secured respectively to the full areas of said end walls, the configuration of the chamber and the spatial relationship of the plates therewith being adapted to enable said plates to generate and confine a substantially uniform field of microwave energy interiorly of the chamber for simultaneous and substantially uniform molecular radiation for the heating of the fluids in the chamber;

(b) said chamber having operably secured thereto thermally controlled electrical switching means being adapted to sense and control temperature of fluids therein;

(c) electrical means for producing and supplying said micro-wave energy to said plates, said electrical means comprising for connection therewith an external power source and said thermally controlled electrical switching means, the thermally controlled electrical switching means being adapted to control the temperature of the fluids within the chamber by directing and by terminating the flow of micro-wave energy to said plates; and (d) insulating means enclosing said chamber to retard heat loss therefrom and a metallic casing to surround said chamber and insulating means to serve as a shield against escape of micro-wave radiation to the atmosphere.

2. The apparatus of claim 1 wherein said electrical means for producing and supplying said micro-wave energy to said plates includes a fluid dispensing faucet cammed as an electric switch for control of said thermally controlled switching means so that when said faucet switch is in open or closed positions, said thermally controlled switching means are in activated or deactivated positions respectively.

3. The apparatus of claim 2 wherein the said chamber outlet is provided with an upper fluid flow path means leading to said faucet and wherein said flow path is provided with cushioning means for averting or minimizing fluid disturbance during heating operation of the apparatus.

4. The apparatus of claim 3 wherein the configuration of said chamber is in the form of a vertically disposed, flat and cylindrical vessel and wherein the conductive plates are circular to overlay and coincide with the end walls of the chamber.

5. The apparatus of claim 4 wherein said cylindrical vessel has a diameter of about eight and one-half inches and an elevation of about two inches to form an approximate two quart capacity.

* * * * *